US009039447B2

(12) United States Patent
Aoki et al.

(10) Patent No.: US 9,039,447 B2
(45) Date of Patent: May 26, 2015

(54) TERMINAL FITTING

(71) Applicant: Yazaki Corporation, Tokyo (JP)

(72) Inventors: Hiroshi Aoki, Toyota (JP); Osamu Oshita, Toyota (JP)

(73) Assignee: Yazaki Corporation, Tokyo (JP)

( * ) Notice: Subject to any disclaimer, the term of this patent is extended or adjusted under 35 U.S.C. 154(b) by 45 days.

(21) Appl. No.: 14/067,181
(22) Filed: Oct. 30, 2013

(65) Prior Publication Data

US 2014/0051289 A1 Feb. 20, 2014

Related U.S. Application Data

(63) Continuation of application No. PCT/JP2012/065289, filed on Jun. 14, 2012.

(30) Foreign Application Priority Data

Jun. 17, 2011 (JP) ..... 2011-135490

(51) Int. Cl.
*H01R 13/432* (2006.01)
*H01R 13/428* (2006.01)

(52) U.S. Cl.
CPC ..... *H01R 13/428* (2013.01); *H01R 13/432* (2013.01)

(58) Field of Classification Search
CPC .. H01R 13/432; H01R 13/428; H01R 13/567; H01R 13/426; H01R 13/424; H01R 13/113; H01R 13/111
See application file for complete search history.

(56) References Cited

U.S. PATENT DOCUMENTS 5,951,336 A 9/1999 Seko et al.
6,042,433 A 3/2000 Chen
6,165,026 A 12/2000 Sugie et al.
8,764,482 B2 * 7/2014 Matsumura et al. ..... 439/595
8,911,268 B2 * 12/2014 Kobayashi et al. ..... 439/752
2004/0224569 A1 11/2004 Katsuma et al.
2014/0051307 A1 * 2/2014 Aoki et al. ..... 439/746

FOREIGN PATENT DOCUMENTS

JP 03147282 6/1991
JP 1040996 A 2/1998
JP 10326638 12/1998
JP 1145750 A 2/1999

(Continued)

OTHER PUBLICATIONS

International Search Report, dated for Jul. 31, 2012, issued by the International Searching Authority in counterpart International Application No. PCT/JP2012/065289.
Written Opinion, dated for Jul. 31, 2012, issued by the International Searching Authority in counterpart International Application No. PCT/JP2012/065289.
Notice to Submit Response dated Sep. 18, 2014 issued by Korean Intellectual Property Office in counterpart Korean application No. 10-2013-7030202.
International Preliminary Report dated Jul. 31, 2012 issued by the International Searching Authority in corresponding International Application No. PCT/JP2012/065289.
Communication issued on Jan. 20, 2015 by the Japanese Patent Office in related application No. 2011135490.

*Primary Examiner* — Gary Paumen
(74) *Attorney, Agent, or Firm* — Sughrue Mion, PLLC

(57) ABSTRACT

A lance which protrudes from the outside surface of a terminal body to prevent falling out of a cavity of a connector housing includes a lance body of an inclined plate shape whose protruding length from the outer surface of the terminal body towards the outside gradually increases from the front end side of the terminal body to the back end side, and a shielding plate which extends from the back end edge of the lance body towards the outer surface of the terminal body so that an opening which opens towards a terminal back end is not formed between the back end edge of the lance body and the outer surface.

1 Claim, 6 Drawing Sheets

(56) References Cited

FOREIGN PATENT DOCUMENTS

| | | | |
|---|---|---|---|
| JP | 2001143807 | A | 5/2001 |
| JP | 200293508 | A | 3/2002 |
| JP | 2002134206 | A | 5/2002 |
| JP | 2002280106 | A | 9/2002 |
| JP | 2004362973 | A | 12/2004 |
| JP | 200692780 | A | 4/2006 |

* cited by examiner

TERMINAL FITTING

CROSS REFERENCE TO RELATED APPLICATIONS

This application is a continuation of PCT application No. PCT/JP2012/065289, which was filed on Jun. 14, 2012 based on Japanese Patent Application (No. P2011-135490) filed on Jun. 17, 2011, the contents of which are incorporated herein by reference.

BACKGROUND OF THE INVENTION

1. Field of the invention

The present invention relates to a terminal fitting for which a lance, by which the terminal fitting is prevented from falling out of a cavity of a connector housing, protrudes from the outside surface of a terminal body.

2. Description of the Related Art

FIG. 6 is a perspective view which shows the construction of a terminal fitting 100 disclosed in JP-A-10-40996.

The terminal fitting 100 includes a terminal body 110 which is formed by press molding a metal plate, and a lance 120 which protrudes from the outside surface of the terminal body 110.

The terminal body 110 has a terminal engaging part 111 at the front end side. The terminal engaging part 111 has a rectangular pipe shape to which a male terminal which is a connecting counterpart is fitted.

The lance 120 is so formed integrally with the terminal engaging part 11 that the lance 120 may be elastically displaced into the terminal engaging part 111 and protrudes from the outside surface of the terminal engaging part 111.

In particular, the lance 120 in the illustrated example is formed by cutting and raising a part of a first outer wall plate part 112 which is an upper side outer wall of the terminal engaging part 111 so that the lance 120 protrudes from the outer surface of the first outer wall plate part 112. The lance 120 is a belt-form protruding piece which obliquely extends from the front end side of the terminal engaging part 111 toward the back end side.

When the terminal fitting 100 in the illustrated example is inserted into a cavity (a terminal insertion hole) of a connector housing (not shown in the figure), the lance 120 enters into a retaining recess formed in the cavity and is prevented from falling out of the cavity.

In JP-A-2002-280106 and JP-A-2002-93508, the following techniques are disclosed. To prevent that the back end edge of the lance, which obliquely extends from the front end side of the terminal engaging part to the back end side as described above, from being deformed outward by an external force, a lance regulating mean (an inner side plate 19 in JP-A-2002-280106 and an engaging hole 41 of a protecting wall 36 in JP-A-2002-93508 correspond to the lance regulating means) is provided to engage with the lance to regulate the lance from being displaced outward.

SUMMARY OF THE INVENTION

However, for the terminal fitting 100 of JP-A-10-40996, as shown in FIG. 6, an opening part 123 which opens between a back end edge 121 of the lance 120 and the outer surface of the first outer wall plate part 112 and towards the terminal back end remains. In JP-A-2002-280106 and JP-A-2002-93508, the situations are similar.

For the terminal fitting 100, for example, if an end of the electric wire 140, which is housed together with the terminal fitting 100, is moved from the back side of the terminal fitting 100 towards the lance 120 as shown with the arrow Y in FIG. 6 at the time of safekeeping or transportation, the end of the electric wire 140 may enter into the back side of the lance 120 from the opening part 123, and becomes entangled with the lance 120.

If the operation of taking out the terminal fitting 100 is performed while the electric wire 140 is entangled with the lance 120, troubles such as that the terminal fitting 100 cannot be taken out because the electric wire 140 is entangled or that the lance is damaged because an unusual load is applied on the lance 120 may occur. Further, because it is necessary to carefully handle the terminal fitting 100 at the time of safekeeping and transportation so that the electric wire end does not enter into the opening part 123, there is a problem that the handleability at the time of safekeeping and transportation is bad.

For the terminal fittings disclosed in JP-A-2002-280106 and JP-A-2002-93508, since the opening part 123 shown in FIG. 6 remains like JP-A-10-40996, the above troubles may also happen like JP-A-10-40996.

Thus, an object of the present invention is to solve the above problems and provide a terminal fitting so that even if the electric wire and the like, which are housed together with the terminal fitting, are moved from the back side of the terminal fitting towards the lance at the time of safekeeping or transportation, the electric wire and the like can be surely prevented from entering into the back side of the lance, and the trouble such as that the lance is damaged because the electric wire and the like enter into the back side of the lance can be prevented from occurring.

The above-mentioned object of the present invention is achieved by the following constructions.

(1) A terminal fitting comprising:

a terminal body which is formed by press molding a metal plate; and a lance which is integrally formed with the terminal body so that the lance is capable of being elastically displaced in the terminal body and protrudes from an outside surface of the terminal body;

wherein when the terminal fitting is inserted into a cavity of a connector housing, the lance enters into a retaining recess formed in the cavity to prevent the terminal fitting from falling out of the cavity; and wherein the lance includes:

a lance body which is formed into an inclined plate whose protruding length from the outer surface of the terminal body towards an outside gradually increases from a front end side of the terminal body to a back end side of the terminal body, and which is prevented from falling out of the cavity when a back end edge of the lance body is retained to the retaining recess; and a shielding plate which extends from the back end edge of the lance body towards the outer surface of the terminal body so that an opening which opens towards a terminal back end is not formed between the back end edge of the lance body and the outer surface of the terminal body.

(2) The terminal fitting according to the above 1, wherein a first outer wall plate part of the terminal body, which has the outside surface from which the lance protrudes outward, is provided with a lance opening through which the lance is movably inserted outward; and wherein the lance has back surface abutting parts, which are overlapped on a back surface of the first outer wall plate part at front and back of the lance opening and which abut against the back surface of the first outer wall plate part to regulate the lance from being displaced outward, at front and back ends of the lance.

(3) The terminal fitting according to above (2), wherein the terminal body includes:

a third outer wall plate part opposed to a second outer wall plate part connected to one end of the first outer wall plate part;

an overlapped wall which is connected to a front end or a back end of the third outer wall plate part, and which is overlapped on the back surface of the first outer wall plate part at the front end side or at the back end side of the first outer wall plate part; and an overlapped piece which extends from the overlapped wall into a belt shape along a front-rear direction of the terminal body and which is overlapped on the back surface of the first outer wall plate part, and wherein the lance body and the shielding plate of the lance are formed by bending a part of the overlapped piece which faces the lance opening.

According to the construction of the above (1), the lance formed in the terminal body includes the shielding plate which extends from the back end edge of the lance body towards the outer surface of the terminal body, and the shielding plate prevents an opening, which opens towards the terminal back end, from being formed at the back end edge side of the lance body.

Therefore, even if the electric wire and the like, which are housed together with the terminal fitting, are moved from the back side of the terminal fitting towards the lance at the time of safekeeping or transportation, it can be surely prevented that the electric wire and the like enter into the back side of the lance.

Therefore, troubles such as the damage of the lance because the electric wire and the like enter into the back side of the lance can be prevented from occurring. Further, it is not necessary to carefully check whether the electric wire and the like are entangled with the lance when the terminal fitting is taken out and transported from the safekeeping location or the like, and the handleability of the terminal fitting at the time of transportation is improved.

According to the construction of the above (2), the front and back ends of the lance formed in the terminal body are provided with the back surface abutting parts which are overlapped on the back surface of the first outer wall plate part of the terminal body. When an external force in such a direction that the lance is to be displaced outward is applied, the back surface abutting parts abut against the back surface of the first outer wall plate part to regulate the lance from being displaced outward. Therefore, troubles such as that the lance is bent outward by an external force can be prevented from occurring.

According to the construction of the above (3), the lance is formed by bending a part of the belt-like overlapped piece, which extends from the overlapped wall that is connected with the third outer wall plate part of the terminal body, and in the unfolded form when the terminal fitting is punched, the overlapped piece becomes a simple belt-like shape which is adjacent to and parallel to the third outer wall plate part. Therefore, when the terminal fitting is punched, material yield can be improved by effective arranging the overlapped piece. It is also possible to form the lance integrally with the terminal body to prevent the material yield from decreasing.

DETAILED DESCRIPTION OF THE EXEMPLARY EMBODIMENTS

A preferred embodiment of the terminal fitting according to the present invention is described in detail with reference to the figures as follows.

Figure 1:
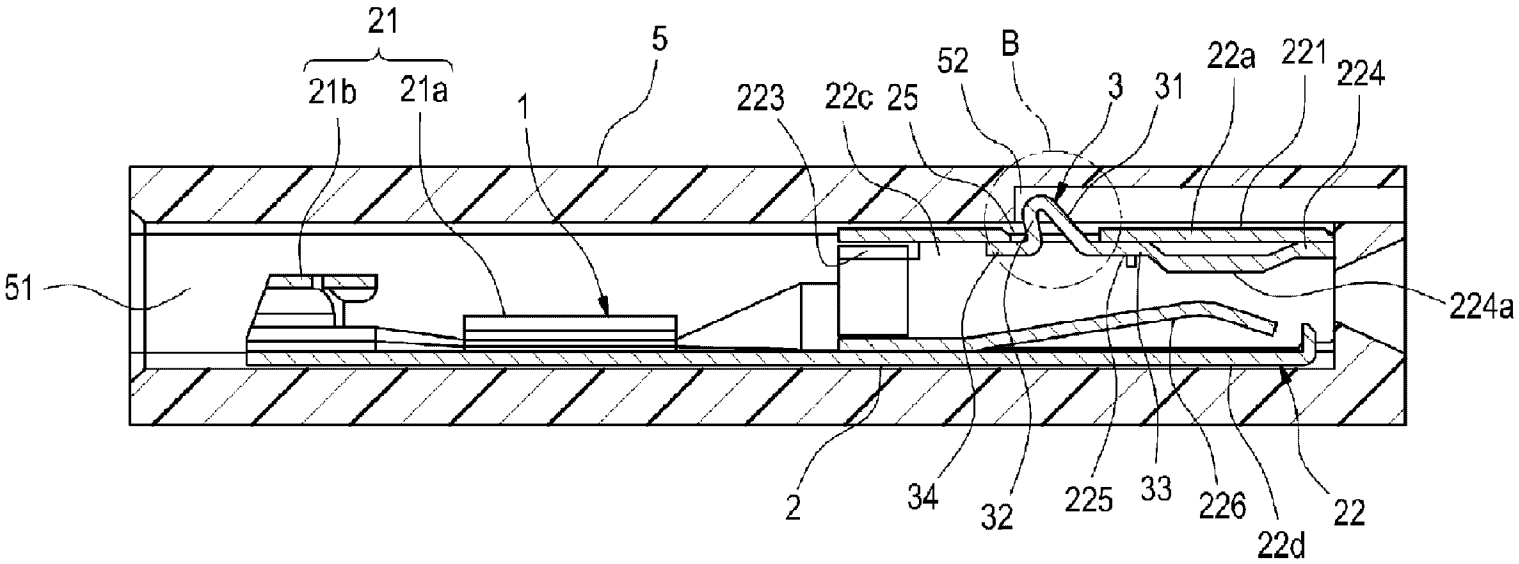
FIG. 1 is a longitudinal sectional view which shows that the terminal fitting according to one embodiment of the present invention is accommodated in a cavity of a connector housing.
Figure 2:
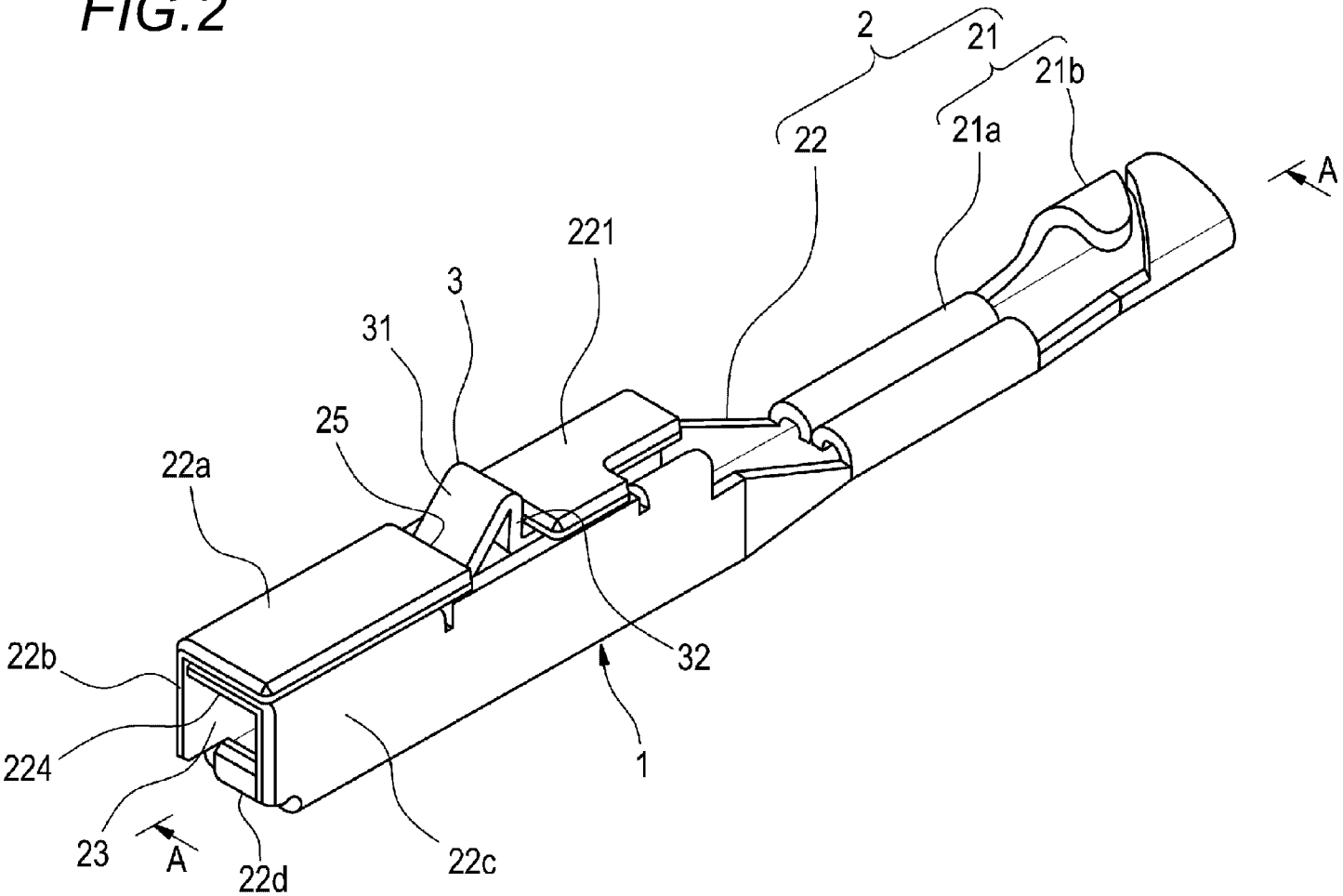
FIG. 2 is a perspective view of the terminal fitting shown in FIG. 1 which is seen obliquely from above at the front end side.

A terminal fitting 1 of the present embodiment is formed by press molding a metal plate and, as shown in FIGS. 1 and 2, includes a terminal body 2 and a lance 3 which is integrally formed with the terminal body 2.

The terminal body 2, as shown in FIG. 2, includes an electric wire crimping part 21 and a terminal engaging part 22.

The electric wire crimping part 21 is a part by which an end of an electric wire (not shown in the figure) is crimped and connected, and includes a conductor crimping piece 21*a* by which the conductor of the electric wire is crimped and a coating fixing part 21*b* which is crimped onto the jacket of the electric wire to fix the electric wire.

The terminal engaging part 22 is a part to which a male terminal which is a connecting counterpart is fitted. The terminal engaging part 22 is formed to be a rectangular pipe shaped structure in which a terminal insertion part 23 into which the male terminal is inserted is surrounded by four outer wall plate parts, which are a first to a fourth outer wall plate parts 22*a*, 22*b*, 22*c* and 22*d*.

In the four outer wall plate parts, which are the first to the fourth outer wall plate parts 22*a*, 22*b*, 22*c* and 22*d*, the first outer wall plate part 22*a* is a plate which is a top side outer wall that covers the upper side of the terminal insertion part 23 when seen from the front of the terminal, the second outer wall plate part 22*b* is a plate which is a left side outer wall that covers the left side of the terminal insertion part 23 when seen from the front of the terminal, the third outer wall plate part 22*c* is a plate which is a right side outer wall that covers the right side of the terminal insertion part 23 when seen from the front of the terminal and the fourth outer wall plate part 22*d* is a plate which is a bottom side outer wall that covers the lower side of the terminal insertion part 23 when seen from the front of the terminal.

When the outer wall plate parts are further described, in the terminal engaging part 22 of the rectangular pipe shaped structure, the second outer wall plate part 22*b* is an outer wall plate part connected with one side (left side edge) of the first outer wall plate part 22*a*, the third outer wall plate part 22*c* is an outer wall plate part facing the second outer wall plate part 22*b*, and the fourth outer wall plate part 22*d* is an outer wall plate part facing the first outer wall plate part 22*a*.

In the present embodiment, in the four outer wall plate part 22*a*, 22*b*, 22*c* and 22*d*, when seen from the front side of the terminal fitting 1, the second outer wall plate part 22*b* is connected with the left side edge of the fourth outer wall plate part 22*d*, the first outer wall plate part 22*a* is connected with the upper edge of the second outer wall plate part 22*b*, and the third outer wall plate part 22*c* is connected with the right side edge of the fourth outer wall plate part 22*d*.

Therefore, although not shown in the figure, when a metal plate is punched into an unfolded form of the terminal fitting 1, the terminal engaging part 22 is punched into an unfolded form sequentially with the first outer wall plate part 22*a*, the second outer wall plate part 22*b*, the fourth outer wall plate part 22*d* and the third outer wall plate part 22*c* in the terminal widthwise direction.

In the present embodiment, an outer surface 221 of the first outer wall plate part 22*a* of the terminal engaging part 22 is equivalent to an outside surface of the terminal body 2 from which the lance 3 protrudes outward. The first outer wall plate part 22*a* of the terminal engaging part 22 is provided with a lance opening 25. The lance opening 25 is a rectangular through hole through which the lance 3 to be described later may be movably inserted outward.

Figure 3:
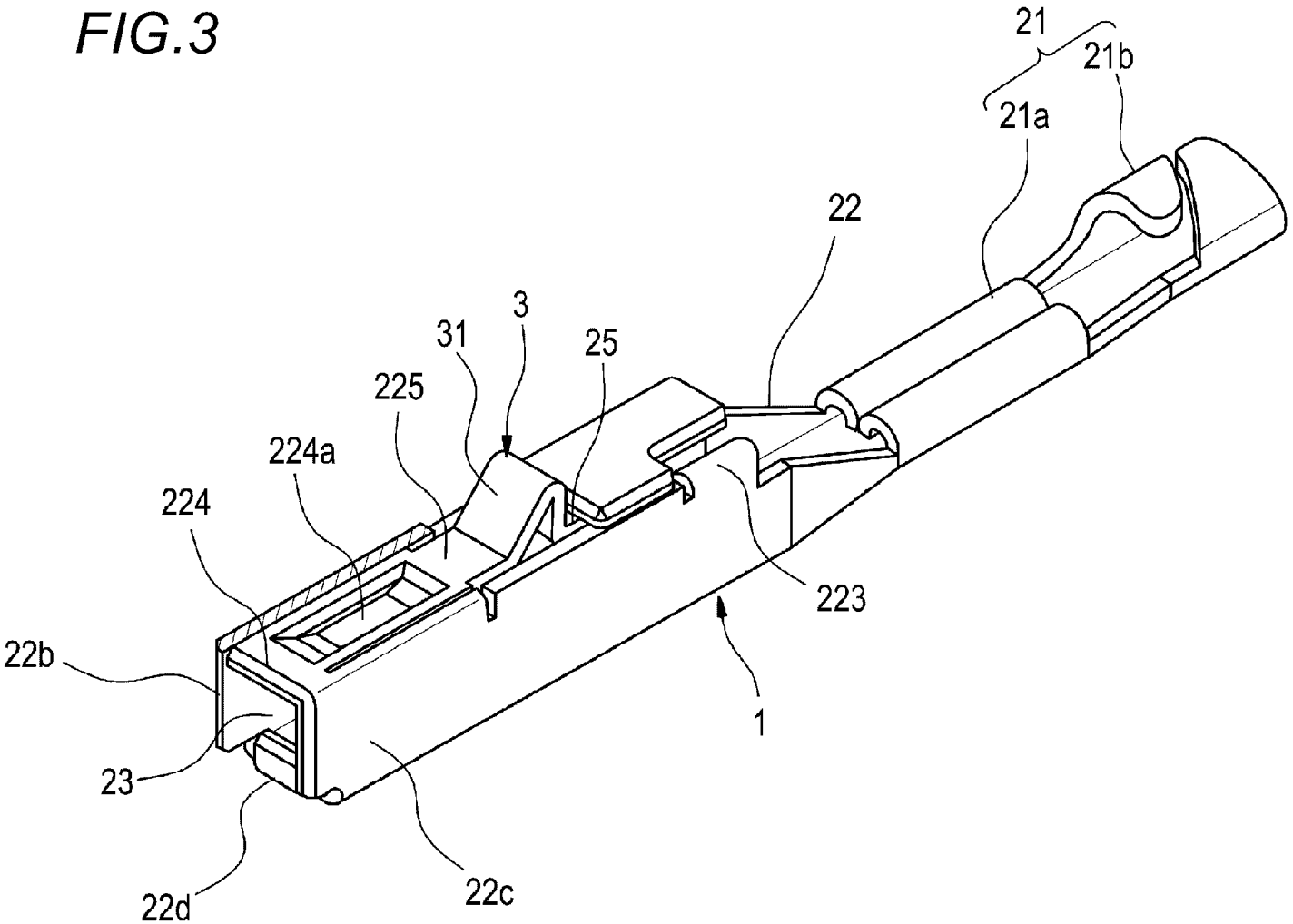
FIG. 3 is a perspective view in which the front end of a first outer wall plate part of a terminal body shown in FIG. 2 is cut out to expose an overlapped wall which is overlapped on the back surface of the first outer wall plate part and a lance.
Figure 4:
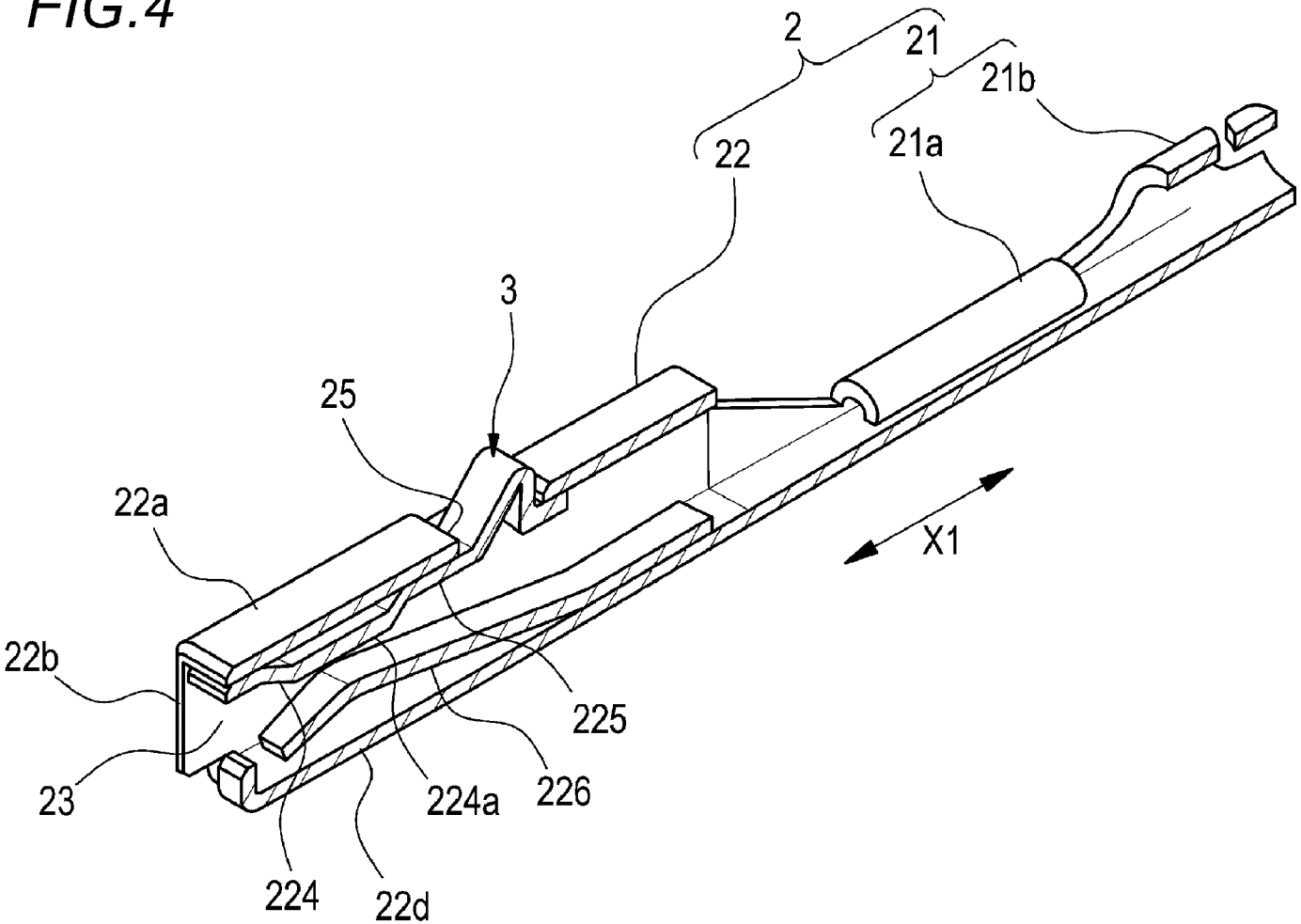
FIG. 4 is a perspective view which shows an A-A section of FIG. 2.

As shown in FIGS. 3 and 4, in the third outer wall plate part 22*c* of terminal body 2, a spring supporting part 223, an overlapped wall 224 and an overlapped piece 225 are integrally formed.

The spring supporting part 223 is provided to be connected with the back end of the third outer wall plate part 22*c*. The spring supporting part 223 extends from the back end of the third outer wall plate part 22*c*, is bent along the inner surface of the third outer wall plate part 22*c*, and is connected with a spring strip 226 shown in FIG. 4 at the distal end which is located at the inner bottom surface side of the fourth outer wall plate part 22*d*. The spring strip 226, as shown in FIG. 4, is arranged to extend in a front-rear direction (an arrow X1 direction as shown in FIG. 4) in the terminal insertion part 23, and is electrically connected to the male terminal which is inserted into the terminal insertion part 23 and which is clamped between the spring strip 226 and the overlapped wall 224 to be described later.

The overlapped wall 224 is provided to connect with the front end of the third outer wall plate part 22*c*, and as shown in FIGS. 1 and 3, is bent and molded to be overlapped on the back surface of the first outer wall plate part 22*a* at the front end side.

The overlapped wall 224 is arranged at a position facing the spring strip 226 as shown in FIG. 1 and clamps a male terminal, which is inserted into the terminal engaging part 22, together with the spring strip 226. As shown in FIGS. 1 and 3, the overlapped wall 224 is press-molded with a projecting part 224*a* which protrudes toward the spring strip 226. The projecting part 224*a* is a part which, together with the spring piece 226, clamps the male terminal to increase the contacting performance with the male terminal.

The overlapped piece 225 extends into a belt shape along the front-rear direction of the terminal body 2 from the overlapped wall 224, and is overlapped on the back surface of the first outer wall plate part 22*a*. The lance 3 to be described later is formed by bending a part of the overlapped piece 225.

The lance 3 is so formed in the terminal body 2 that the lance 3 may be elastically displaced in the terminal body 2 and protrudes from the outside surface of the first outer wall plate part 22*a*.

When the terminal fitting 1 is inserted into a cavity (a terminal insertion hole) 51 of a connector housing 5 as shown in FIG. 1, the lance 3 enters into a retaining recess 52 formed in the cavity 51 and is prevented from falling out of the cavity 51.

Figure 5:
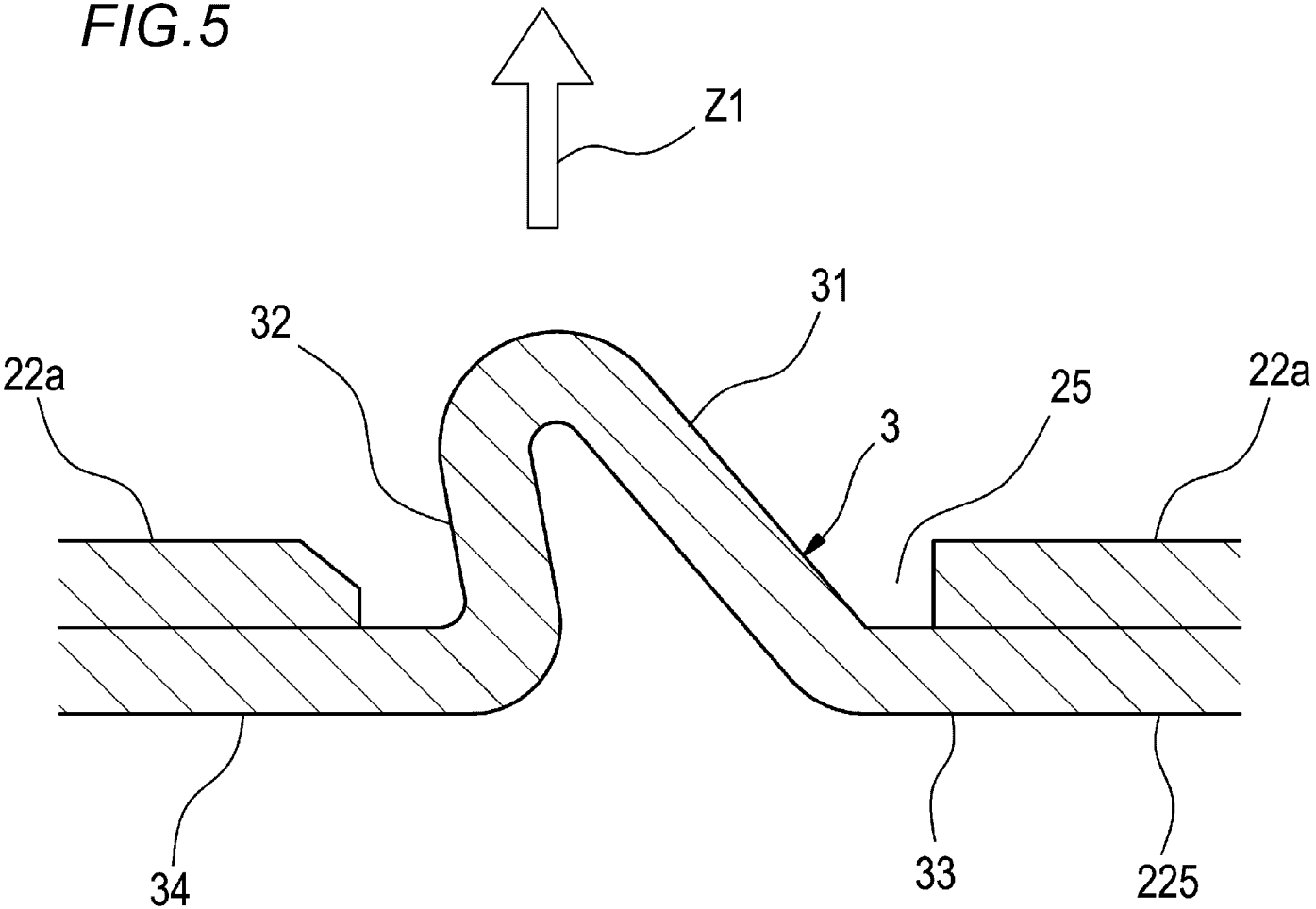
FIG. 5 is an illustrative figure which schematically shows a positional relationship between the lance and the first outer wall plate part in a B part of FIG. 1.

As shown in FIGS. 1 and 5, the lance 3 in the present embodiment includes a lance body 31 and a shielding plate 32.

The lance body 31 is formed into an inclined plate whose protruding length from the outer surface of the first outer wall plate part 22*a*, which is the outer surface of the terminal body 2, towards the outside (arrow Z1 direction of FIG. 5) gradually increases from the front end side (right end side in FIG. 1) of the terminal body 2 to the back end side, and is prevented from falling out of the cavity 51 when the back end edge of the lance body 31 is retained to the retaining recess 52.

The shielding plate 32 extends from the back end edge of the lance body 31 towards the outer surface of the first outer wall plate part 22*a* so that an opening which opens from the lance opening 25 towards the terminal back end is not formed between the back end edge of the lance body 31 and the outer surface of the first outer wall plate part 22*a*.

Furthermore, for the terminal fitting 1 of the present embodiment, as shown in FIG. 5, the lance 3 includes back surface abutting parts 33 and 34, which are overlapped on the back surface of the first outer wall plate part 22*a* before and after the lance opening 25, at the front and back ends of the lance 3.

When the lance 3 is pulled outward by an external force, the back surface abutting parts 33, 34 abut against the back surface of the first outer wall plate part 22*a* to regulate the lance 3 from being displaced outward.

The lance body 31 and the shielding plate 32 of the lance 3 described above are formed by bending to shape a part of the overlapped piece 225 that faces the lance opening 25. By bending a part of the overlapped piece 225 to shape the lance 3, the parts at the front and back of the lance 3 function as the above-mentioned back surface abutting parts 33 and 34.

Figure 6:
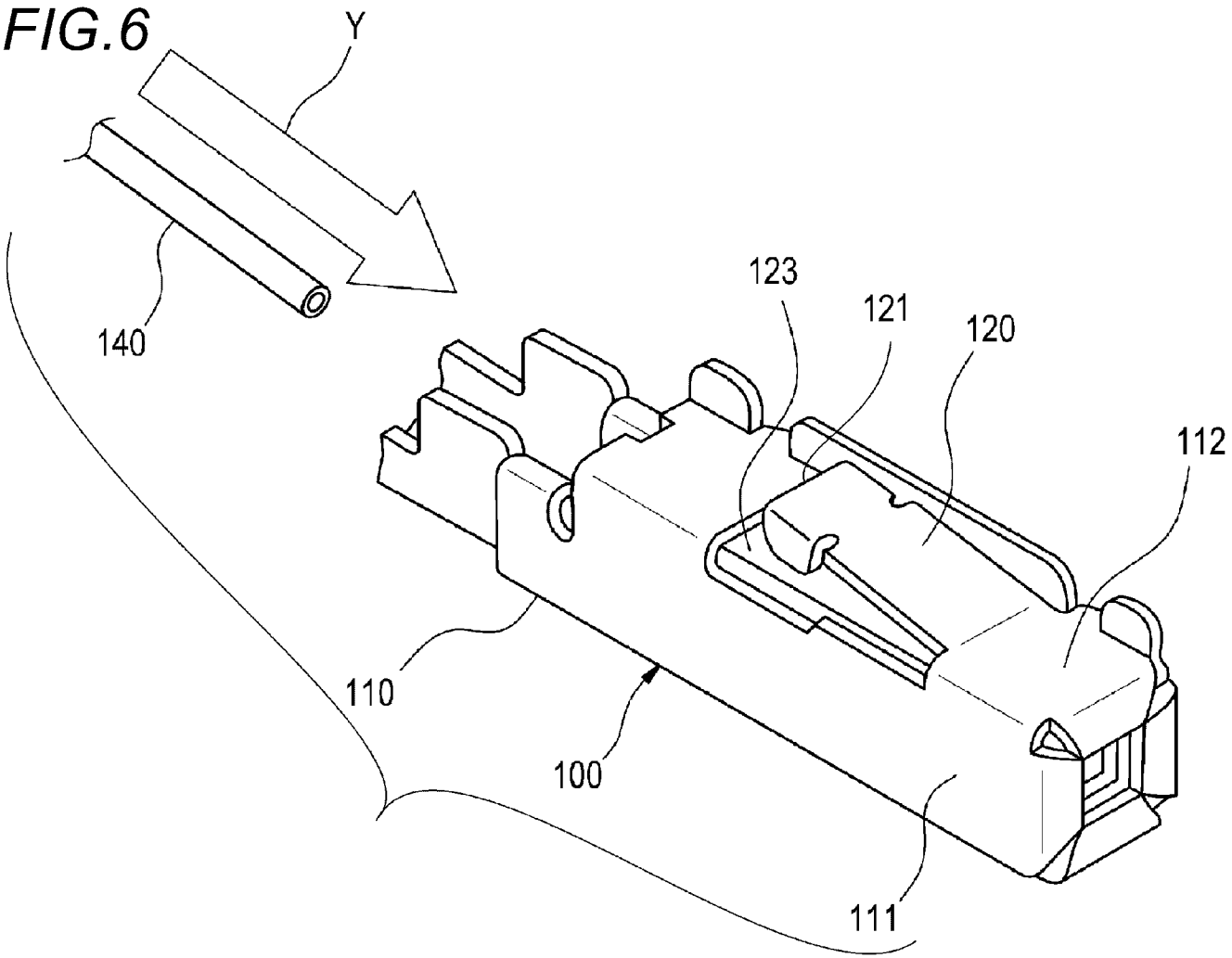
FIG. 6 is a perspective view of a traditional terminal fitting.

In the terminal fitting 1 of the above-described embodiment, the lance 3 formed in the terminal body 2 includes the shielding plate 32 which extends from the back end edge of the lance body 31 towards the outside surface of the terminal body 2, and the shielding plate 32 prevents an opening (opening part 123 shown in FIG. 6), which opens towards the terminal back end since the lance opening 25 has been formed, from being formed at the back end edge side of the lance body 31.

Therefore, even if the electric wire and the like, which are housed together with the terminal fitting, are moved from the back side of the terminal fitting 1 towards the lance 3 at the time of safekeeping or transportation, it can be surely prevented that the electric wire and the like enter into the back side of the lance 3.

Therefore, troubles such as the damage of the lance 3 because the electric wire and the like enter into the back side of the lance 3 can be prevented from occurring. Further, it is not necessary to carefully check whether the electric wire and the like are entangled with the lance 3 when the terminal fitting 1 is taken out and transported from the safekeeping location or the like, and the handleability of the terminal fitting 1 at the time of transportation is improved.

In the terminal fitting 1 of the above-described embodiment, the front and back ends of the lance 3 formed in the terminal body 2 are provided with the back surface abutting parts 33 and 34 which are overlapped on the back surface of the first outer wall plate part 22*a* of the terminal body 2 as shown in FIG. 5. When an external force in such a direction that the lance 3 is to be displaced outward is applied, the back surface abutting parts 33, 34 abut against the back surface of the first outer wall plate part 22*a* to regulate the lance 3 from being displaced outward. Therefore, troubles such as that the lance 3 is bent outward by an external force can be prevented from occurring.

In the terminal fitting 1 of the above-described embodiment, the lance 3 is formed by bending a part of the belt-like overlapped piece 225, which extends from the overlapped wall 224 that is connected with the third outer wall plate part 22*c* of the terminal body 2. Thus, in the unfolded form when the terminal fitting 1 is punched, the overlapped piece 225 becomes a simple belt-like shape which is adjacent to and parallel to the third outer wall plate part 22*c*.

Therefore, when the terminal fitting 1 is punched, material yield can be improved by effective arranging the overlapped piece 225. It is also possible to form the lance 3 integrally with the terminal body 2 to prevent the material yield from decreasing.

The terminal fitting of the present invention is not limited to the embodiment described previously, and it is possible to make appropriate transformation, improvement or the like.

For example, in the previously described embodiment, the overlapped piece 225 where the lance 3 is formed has a belt-like shape which extends from the overlapped wall 224, which is connected to the front end of the third outer wall plate part 22*c*, to the back end side of the terminal body 2, but it is also possible that the overlapped wall 224 is connected to the back end of the third outer wall plate part 22*c* and the overlapped piece 225 is formed into a belt-like shape which extends from the overlapped wall 224 to the front end side of the terminal body 2.

The part of the terminal body 2 where the lance 3 is integrally formed is not limited to the third outer wall plate part 22*c* shown in the previously described embodiment. For example, it is also possible that the lance 3 is formed integrally with the first outer wall plate part 22*a* by cutting and raising a part of the first outer wall plate part 22*a*.

According to the terminal fitting of the present invention, the shielding plate included in the lance prevents an opening, which opens towards the terminal back end, from being formed at the back end edge side of the lance body. Therefore, even if the electric wire and the like, which are housed together with the terminal fitting, are moved from the back side of the terminal fitting towards the lance at the time of safekeeping or transportation, it can be surely prevented that the electric wire and the like enter into the back side of the lance.

As a result, troubles such as the damage of the lance because the electric wire and the like enter into the back side of the lance can be prevented from occurring. Further, it is not necessary to carefully check whether the electric wire and the like are entangled with the lance when the terminal fitting is taken out and transported from the safekeeping location or the like, and the handleability of the terminal fitting at the time of transportation is improved.

What is claimed is:

1. A terminal fitting comprising:

a terminal body which is formed by press molding a metal plate; and a lance which is integrally formed with the terminal body so that the lance is capable of being elastically displaced in the terminal body and protrudes from an outside surface of the terminal body;

wherein when the terminal fitting is inserted into a cavity of a connector housing, the lance enters into a retaining recess formed in the cavity to prevent the terminal fitting from falling out of the cavity; and wherein the lance includes:

a lance body which is formed into an inclined plate whose protruding length from the outer surface of the terminal body towards an outside gradually increases from a front end side of the terminal body to a back end side of the terminal body, and which is prevented from falling out of the cavity when a back end edge of the lance body is retained to the retaining recess; and a shielding plate which extends from the back end edge of the lance body towards the outer surface of the terminal body so that an opening which opens towards a terminal back end is not formed between the back end edge of the lance body and the outer surface of the terminal body;

wherein a first outer wall plate part of the terminal body, which has the outside surface from which the lance protrudes outward, is provided with a lance opening through which the lance is movably inserted outward;

wherein the lance has back surface abutting parts, which are overlapped on a back surface of the first outer wall plate part at front and back of the lance opening and which abut against the back surface of the first outer wall plate part to regulate the lance from being displaced outward, at front and back ends of the lance;

wherein the terminal body includes:

a third outer wall plate part opposed to a second outer wall plate part connected to one end of the first outer wall plate part;

an overlapped wall which is connected to a front end or a back end of the third outer wall plate part, and which is overlapped on the back surface of the first outer wall plate part at the front end side or at the back end side of the first outer wall plate part; and an overlapped piece which extends from the overlapped wall into a belt shape along a front-rear direction of the terminal body and which is overlapped on the back surface of the first outer wall plate part;

wherein the lance body and the shielding plate of the lance are formed by bending a part of the overlapped piece which faces the lance opening; and wherein the overlapped wall clamps a male terminal, which is inserted into a terminal insertion part of the terminal body, together with the spring strip arranged in the terminal insertion part.

* * * * *